United States Patent [19]

Lofink

[11] 3,987,735

[45] Oct. 26, 1976

[54] RAILWAY CAR SPOTTING SYSTEM

[75] Inventor: Gerard V. Lofink, Coraopolis, Pa.

[73] Assignee: Heyl & Patterson, Inc., Pittsburgh, Pa.

[22] Filed: Aug. 21, 1975

[21] Appl. No.: 606,358

[52] U.S. Cl. ..... 104/176; 104/183; 104/196; 254/172

[51] Int. Cl.[2] ..... B61J 3/06

[58] Field of Search ..... 104/180, 183, 196, 176; 254/172, 149, 173 B, 184, 145

[56] References Cited

UNITED STATES PATENTS

| | | | |
|---|---|---|---|
| 1,557,784 | 10/1925 | Sharpnack | 104/183 |
| 2,767,662 | 10/1956 | Howard et al. | 104/176 X |
| 3,084,725 | 4/1963 | Siverson | 104/196 |
| R27,300 | 2/1972 | Ludwig | 104/176 |

FOREIGN PATENTS OR APPLICATIONS

| | | | |
|---|---|---|---|
| 1,092,796 | 11/1960 | Germany | 104/196 |

*Primary Examiner*—Robert J. Spar
*Assistant Examiner*—James M. Slattery
*Attorney, Agent, or Firm*—Brown, Murray, Flick & Peckham

[57] ABSTRACT

A railway car positioning carriage movable back and forth along a track parallel to a railway track is provided with a member for engagement with the end of a car on the railway track to move it. A pair of sheaves are rotatably mounted on the carriage, and first and second anchor devices are disposed at opposite ends of its track. A wire rope is secured at one end to each of the anchor devices and each rope extends therefrom toward the carriage and around one of the sheaves. The other ends of the ropes are connected to a member for pulling on either rope while simultaneously paying out the other one to thereby pull the carriage along its track. One of the ropes can be temporarily released from its anchor device and detachably connected to the carriage, which can then be pulled by the other rope so that the carriage will pull the released rope across its anchor device to take up slack in the ropes.

7 Claims, 6 Drawing Figures

RAILWAY CAR SPOTTING SYSTEM

It is common practice to unload railway hopper cars by moving them into apparatus that rotates them on a longitudinal axis far enough for their contents to slide out. A common way of moving the cars into proper position in the dumping apparatus is by means of a carriage that is moved back and forth along a track beside the railway track at the entering end of the dumper. The carriage is provided with means for engaging the end of a car on the railway track to push it ahead when the carriage is moved forward. The carriage is usually moved along its own track by means of two wire ropes extending around sheaves mounted on the carriage, one rope extending forward from a sheave and the other rope extending backward. The end of one rope is anchored at one end of the path of travel of the carriage and the other end is attached to a rotatable drum after first passing around a sheave near the rope anchor. One end of the other rope is attached to the drum and extends around a sheave at the other end of the carriage track before extending back to the carriage. The other end of this rope may be connected to the outer end of a piston rod projecting from a hydraulic cylinder that is anchored near the end of the carriage track. When the drum is rotated in either direction, one of the ropes is unwound from it and the other is wound onto it so that the carriage is pulled along its track.

As there is considerable strain on the wire ropes in moving the railway cars, especially on the rope that pulls the carriage forward, they inevitably stretch and this could result in undesirable slack. To take up the slack before it becomes too great, hydraulic fluid is delivered periodically to the rod end of the cylinder mentioned above to move the rod farther into the cylinder and thereby pull on the ropes. This system is satisfactory until the piston can move no further toward the outer end of the cylinder. Then it is necessary to move the piston back toward the other end of the cylinder, disconnect the rope from the piston rod, take up the slack and reconnect the rope to the rod, all of which takes considerable time and effort.

It is among the objects of this invention to provide a railway car spotting system in which the car-spotting carriage itself is used to take up slack in the ropes that move it, and in which this can be done quickly and easily.

The invention is illustrated in the accompanying drawings, in which

Figure 1:
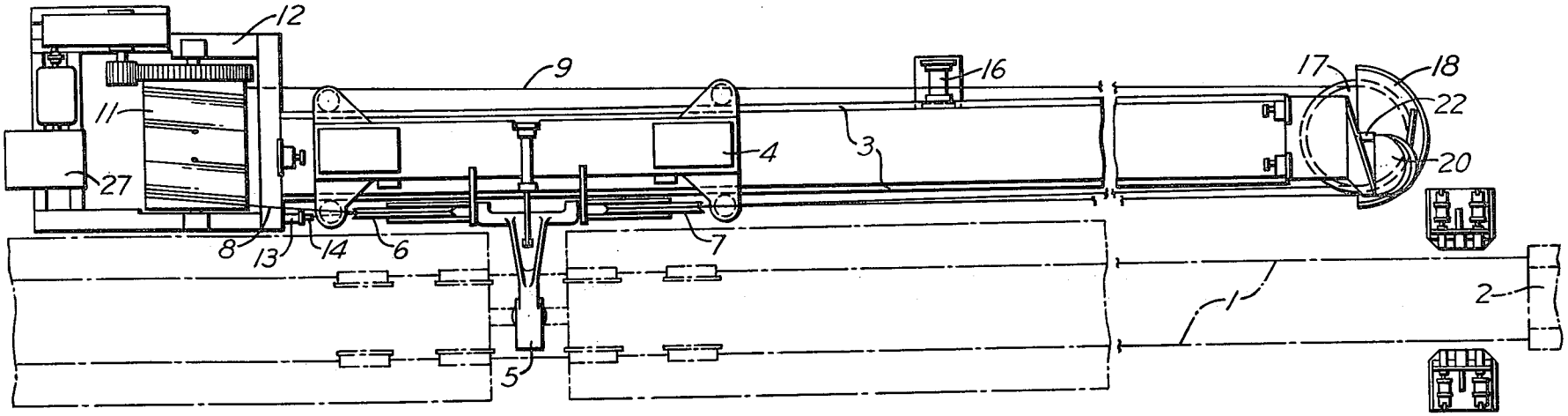
FIG. 1 is a plan view.

Referring to FIG. 1 of the drawing, a railway track 1 is shown leading to the entrance to a rotary car dumper 2. Close to this track and parallel to it there is another track 3, along which a car spotting carriage 4 can travel. The path of travel of the carriage is relatively short, generally about 100 feet or a little less. The carriage is provided with means for engaging the end of a railway car on track 1 in order to push it toward the dumper. Such means generally takes the form of an arm 5 pivoted on a horizontal axis so that it can be swung from an upright position (FIG. 2) clear of the cars to a laterally projecting position between the cars (FIG. 1). The free end of the arm is formed to engage a car coupling or even the end frame of the car. A pair of vertical sheaves 6 and 7 are rotatably mounted near the ends of the carriage at the side adjacent the railway track. To move the carriage back and forth along its track, there are two wire ropes 8 and 9 that extend around these sheaves.

Figure 2:
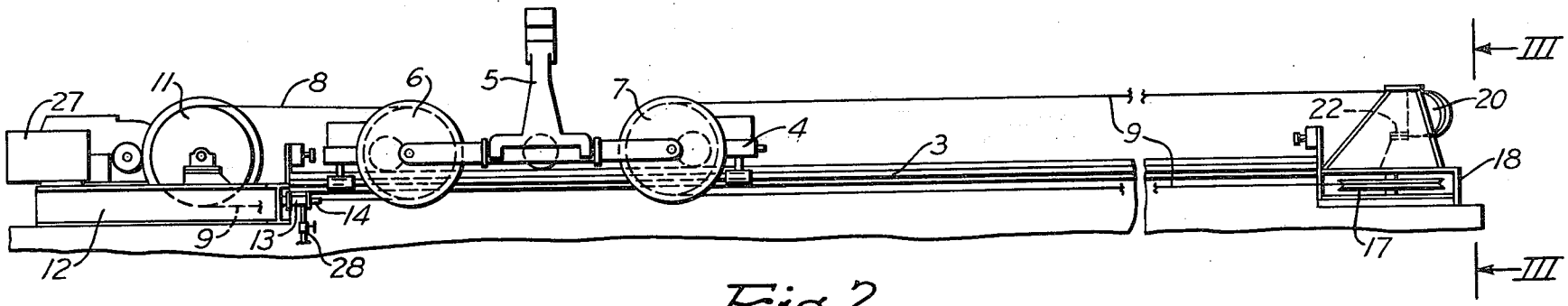
FIG. 2 is a side view.

One end of the first rope 8 is attached to a horizontal drum 11 rotatably mounted on a frame 12 secured at one end of the carriage track. As shown in FIG. 2, this rope extends from the top of the drum to the carriage and around the nearest sheave 6 and then back to anchor means secured to the frame. This anchor means preferably consists of a hydraulic cylinder 13 attached to frame 12 and provided with a piston from which a piston rod 14 extends outwardly toward the carriage, with the adjacent end of the rope secured to the outer end of the rod. One end of the other rope is also attached to the drum, but leaves the bottom of the drum at the end of the drum farthest from the railway track, as shown in FIG. 1. The two ropes are wound in opposite directions on the drum so that as one is wound onto the drum, the other will unwind from it. The second rope 9 extends from the drum the full length of the carriage track, beside which there are horizontal guide rollers 16 that support the rope. At the opposite end of the carriage track this second rope extends around a horizontal sheave 17 rotatably mounted in a stationary frame 18, and then forward to the carriage, around sheave 7 and then back to anchor means at the end of the carriage track.

Figure 3:
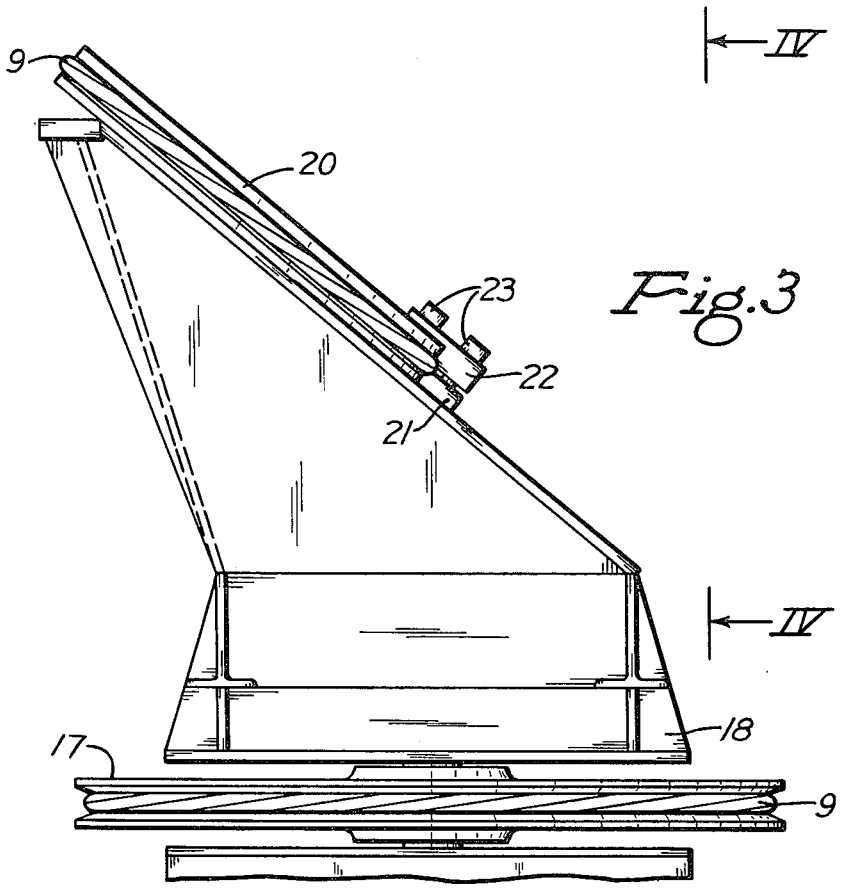
FIG. 3 is an enlarged end view taken on the line III-III of FIG. 2.
Figure 4:
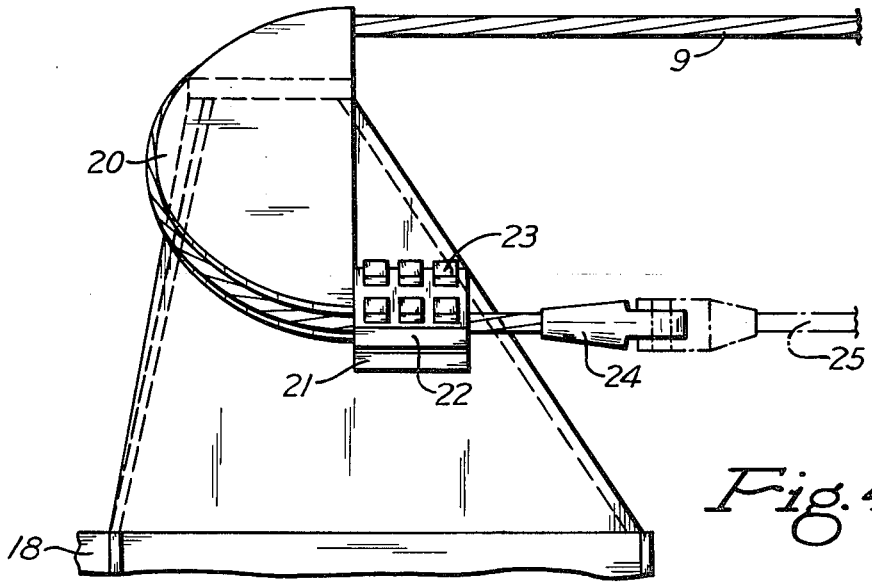
FIG. 4 is a fragmentary side view taken on the line IV-IV of FIG. 3.

This anchor means preferably is located above horizontal sheave 17 and, as shown best in FIGS. 3 and 4, includes a rigidly mounted plate 20 provided with a semicircular groove in which rope 9 is seated. The plate is inclined transversely of the carriage track from a point about on a level with the top of the carriage sheaves downwardly to a point above the axis of the horizontal sheave. The lower end of this plate is about on the same level as the axes of the carriage sheaves. Mounted on the lower part of the inclined plate is a clamp formed from a stationary part 21 and a removable part 22 connected together by bolts 23. The two parts contain matching grooves, through which the adjoining end of the second rope extends and in which it normally is clamped. The projecting end of the rope is fitted with a suitable connecting member 24 by which it can be connected to the adjacent end of the carriage either directly or by means of a short cable 25 that is removable from both.

When the wire ropes are installed, they are made as taut as possible and the piston in the hydraulic cylinder is at its rod end so that the piston rod projects as far as possible. By rotating the drum by means of a reversible motor 27 mounted on frame 12, either rope can be wound on the drum while the other rope is unwound from it, whereby the carriage will be pulled along its track by the rope that is being wound onto the drum. Since the carriage must push one or more cars at a time into the dumper, the rope that is pulling the carriage toward the dumper is subjected to considerable tension, which gradually stretches it. Therefore, periodically hydraulic pressure is delivered to the rod end of the cylinder 13 by any suitable means in order to retract the piston rod, which will take up the slack in the ropes. After the slack has been taken up, the fluid in the cylinder is sealed therein by closing a valve 28 at the inlet to hold the rod in its retracted position. This conventional manner of taking up slack may occur several times, until the rod has been retracted as far as it will go.

Figure 5:
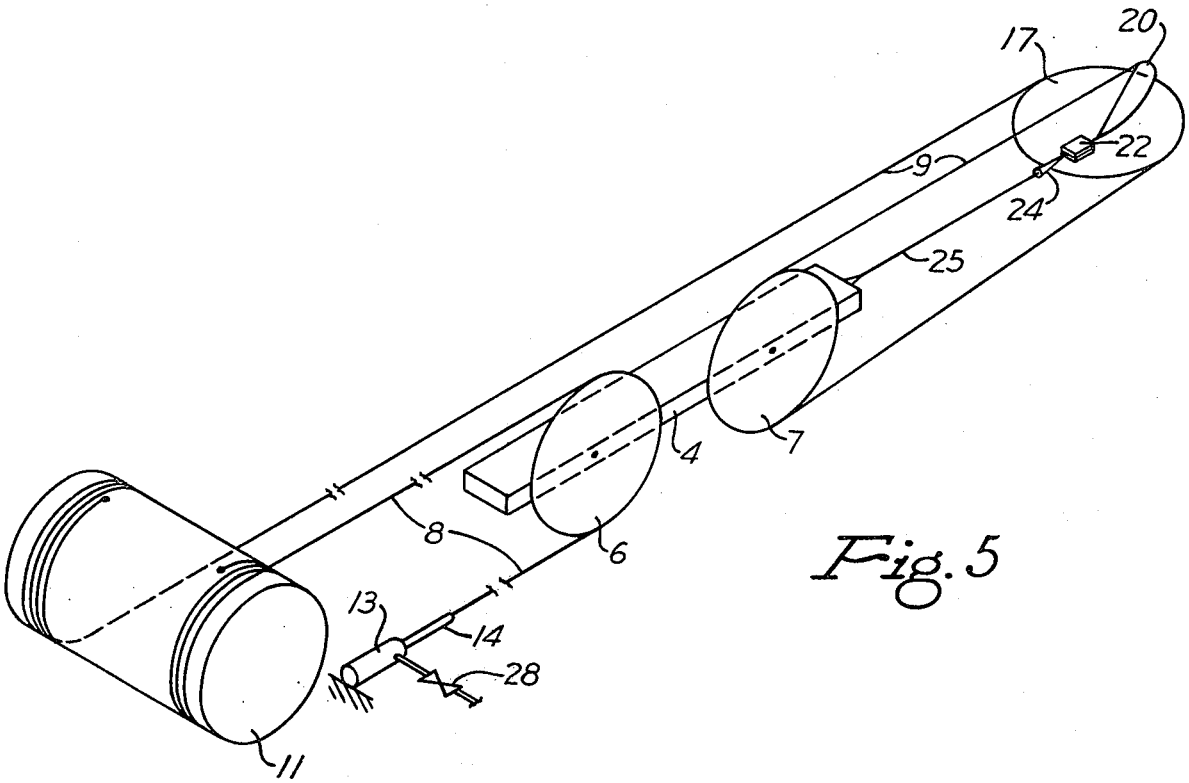
FIG. 5 is a diagrammatic representation of the invention.

It is a feature of this invention that the carriage itself then can be used for taking up further slack and pulling the piston rod 14 out of the cylinder to its original position. To do this, bolts 23 are loosened to loosen the clamp from the second rope 9, and the released end of the rope is connected to the carriage, such as by cable 25 (FIG. 5) detachably connected to connecting member 24 secured to the end of the wire rope. Also, valve 28 is opened so that the hydraulic fluid in the cylinder can escape. The drum then is rotated to wind on the first rope 8, which will pull the piston rod toward the carriage until it is once again in a fully extended position from which it can be retracted later to take up further slack. As the piston rod is being pulled out of the cylinder, rope 9 will be unwound from the drum to some extent, putting more slack in that rope. As the first rope 8 continues to be wound on the drum, after the piston rod has been extended, it pulls the carriage toward the drum, which in turn pulls the previously clamped end of the second rope along with it. This causes this rope to be pulled around the grooved plate 20 until all of the slack in rope 9 is removed. The clamp is then bolted back against the rope to anchor it, following which cable 25 is disconnected from the rope and carriage. The carriage then is ready to be operated again in the usual way.

Figure 6:
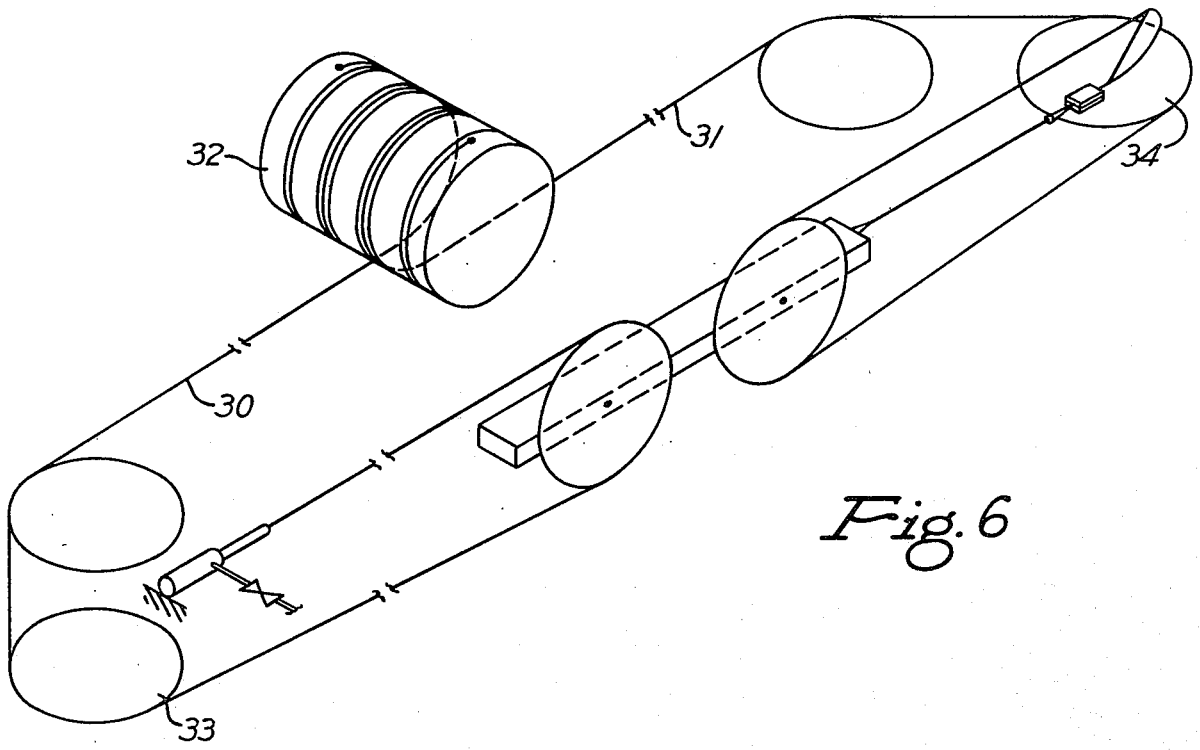
FIG. 6 is a diagrammatic representation of a modification.

It will be seen that with this arrangement only one sheave is required in addition to the usual two carriage sheaves, thereby reducing the cost of this apparatus materially. On the other hand, if the cost factor is ignored, the same system of taking up slack can be used if the drum is mounted at one side of the carriage track between its ends. In such a case, as shown in FIG. 6, both ropes 30 and 31 must extend from the drum 32 around sheaves 33 and 34 mounted at the opposite ends of the carriage track. In either case the carriage itself is used for quickly pulling the slack out of the ropes, and also for extending the piston rod from the hydraulic cylinder when such a cylinder is used.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A railway car spotting system comprising a carriage movable back and forth along a track parallel to a railway track, means on the carriage for engagement with an end of a car on the track, a pair of sheaves rotatably mounted on the carriage, first and second anchor means disposed at opposite ends of the carriage track, a first wire rope secured at one end to the first anchor means and extending therefrom toward the carriage and around one of said sheaves and back toward the first anchor means, a second wire rope secured at one end to the second anchor means and extending therefrom toward the carriage and around the other sheave and back toward the second anchor means, means connected to the other ends of the ropes for pulling on either rope while simultaneously paying out the other one to thereby pull the carriage along its track, means for temporarily releasing from the second anchor means the end of the rope secured thereto, and means for detachably connecting the carriage with said released rope end so that when the carriage is pulled by the first rope the carriage will pull the released second rope across its anchor means and towards the first anchor means to take up slack in the ropes.

2. A railway car spotting system according to claim 1, in which said second anchor means include a rigid support around which said second rope extends, and a releasable clamp normally holding that rope in fixed relation to said support.

3. A railway car spotting system according to claim 1, in which said rope-pulling means include a drum rotatably mounted at one end of the carriage track, and means for rotating the drum in opposite directions, said other ends of the ropes being attached to the drum with the ropes wound around it in opposite directions, one of the ropes extending from the drum directly to one of the carriage sheaves, said system including a sheave at the opposite end of the carriage track from said drum, and the other rope extending from the drum around said last-mentioned sheave and then to the other carriage sheave.

4. A railway car spotting system according to claim 1, including a sheave rotatably mounted adjacent each end of the carriage track, said rope-pulling means including a drum rotatably mounted between the end sheaves, and means for rotating the drum in opposite directions, said other ends of the ropes being attached to the drum with the ropes wound around it in opposite directions, one rope extending from the drum around one of said end sheaves and then to one of the carriage sheaves, and the other rope extending from the drum around the other end sheave and then to the other carriage sheave.

5. A railway car spotting system according to claim 1, in which said first anchor means includes a hydraulic cylinder mounted in fixed position and provided with a projecting piston rod attached to the first rope, means for delivering hydraulic fluid to the rod end of the cylinder to take up slack in the ropes, and means for releasing said fluid from the cylinder while the carriage is pulling said released second rope, whereby said piston rod will be pulled outwardly of the cylinder as the carriage takes up slack.

6. A railway car spotting system according to claim 5, in which said rope-pulling means include a drum rotatably mounted adjacent said hydraulic cylinder, and means for rotating the drum in opposite directions, said other ends of the ropes being attached to the drum with the ropes wound around it in opposite directions, said first rope extending from the drum directly to one of said carriage sheaves, said system including a sheave adjacent said second anchor means, and said second rope extending from the drum around said last-mentioned sheave and then to the other carriage sheave.

7. A railway car spotting system according to claim 6, in which said second anchor means include a rigid support around which said second rope extends, and a releasable clamp normally holding that rope in fixed relation to said support.

* * * * *